US005558470A

United States Patent [19]

Elmore et al.

[11] Patent Number: 5,558,470

[45] Date of Patent: *Sep. 24, 1996

[54] SYSTEM AND METHOD FOR ADJUSTABLY ANCHORING TRAFFIC BARRIERS AND WALL FACING PANELS TO THE SOLDIER BEAMS OF A WALL

[75] Inventors: J. Thomas Elmore; Alan Veatch, both of Washington, D.C.; William C. Clements, Reston, Va.; Victor Elias, Bethesda, Mass.; Longine J. Wojciechowski, Gaithersburg, Md.

[73] Assignee: JTE, Inc., Lorton, Va.

[ * ] Notice: The term of this patent shall not extend beyond the expiration date of Pat. No. 5,356,242.

[21] Appl. No.: 323,732

[22] Filed: Oct. 17, 1994

Related U.S. Application Data

[63] Continuation-in-part of Ser. No. 958,260, Oct. 9, 1992, Pat. No. 5,356,242.

[51] Int. Cl.[6] ..... E02D 29/00

[52] U.S. Cl. ..... 405/262; 405/285; 405/287

[58] Field of Search ..... 405/262, 275, 405/284, 285, 286, 287, 287.1, 272, 258

[56] References Cited

U.S. PATENT DOCUMENTS

| | | | |
|---|---|---|---|
| 4,369,004 | 1/1983 | Weatherby . | |
| 4,391,557 | 7/1983 | Hilfiker et al. . | |
| 4,470,728 | 9/1984 | Broadbent . | |
| 4,653,962 | 3/1987 | McKittrick et al. | 405/286 |
| 4,790,690 | 12/1988 | Vidal et al. . | |
| 4,836,718 | 6/1989 | Deaton . | |
| 4,913,594 | 4/1990 | Sigourney | 405/285 |
| 4,952,097 | 8/1990 | Kulchin . | |
| 4,961,673 | 10/1990 | Pagano et al. . | |
| 5,002,436 | 3/1991 | Sigourney | 405/262 |
| 5,158,399 | 10/1992 | Flores . | |

*Primary Examiner*—William P. Neuder

*Attorney, Agent, or Firm*—Sixbey, Friedman, Leedom & Ferguson

[57] ABSTRACT

A system and method for adjustably connecting traffic barriers and pre-cast wall facing panels to the soldier beams of a pile wall is provided, which includes a connecting structure cast-in-place between the upper ends of the beam and the panels for structurally interconnecting both a traffic barrier and the upper ends of the panels to the beam. The system further includes an anchor member projecting from the upper end of the soldier beam for securing the connecting structure to the beam, as well as a depth-adjustable array of reinforcing members that are cast within the structure for accommodating variations in the distances between the beams and panels. At least one of the array of reinforcing members projects upwardly out of the connecting structure to link the traffic barrier to the connecting structure. In the method of the invention, the connecting structure is cast-in-place on top of a connecting column that secures the wall panels to the soldier beams, and the traffic barrier is in turn cast over the connecting structure after it sets.

18 Claims, 6 Drawing Sheets

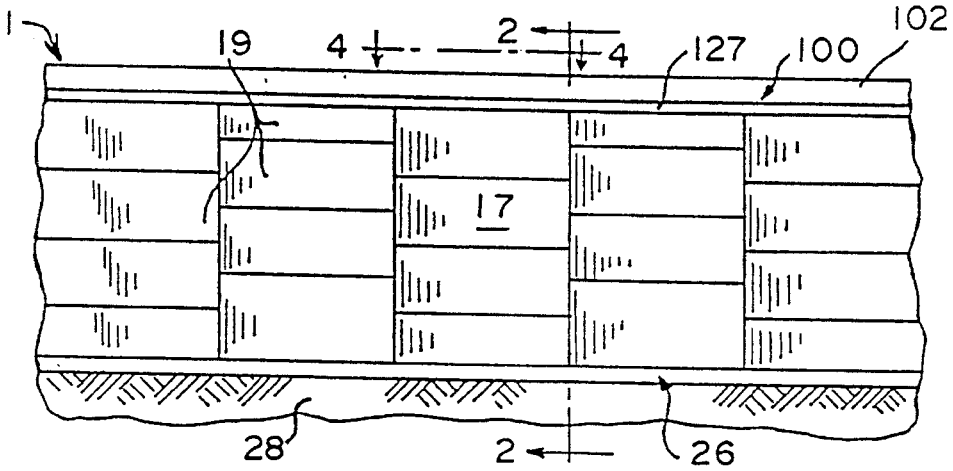
FIG. 1
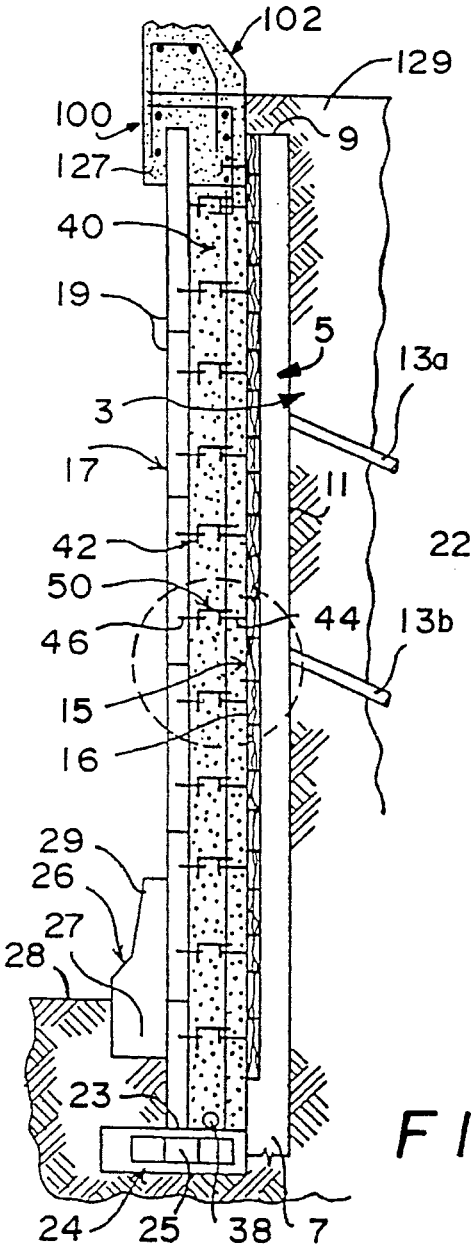
FIG. 2
FIG. 3
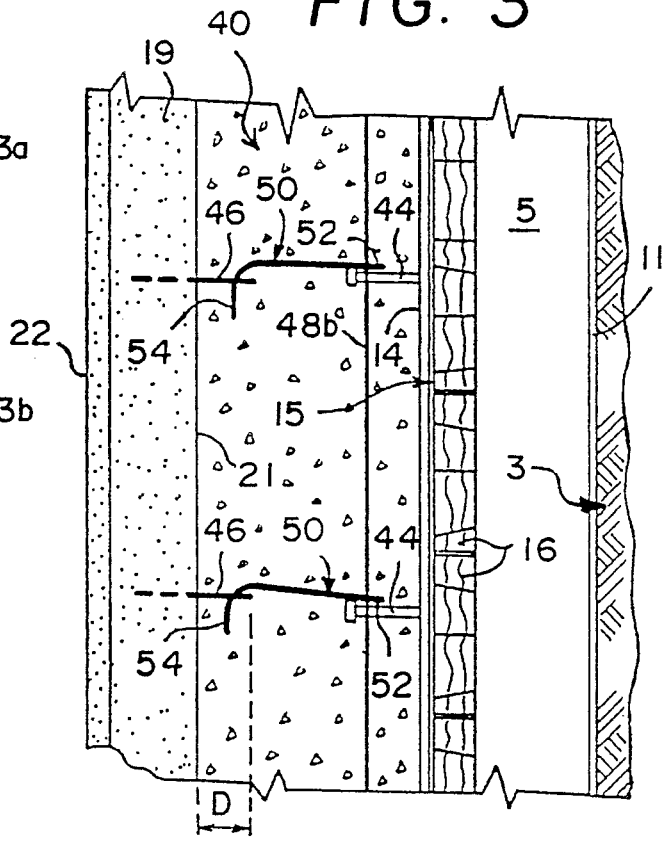

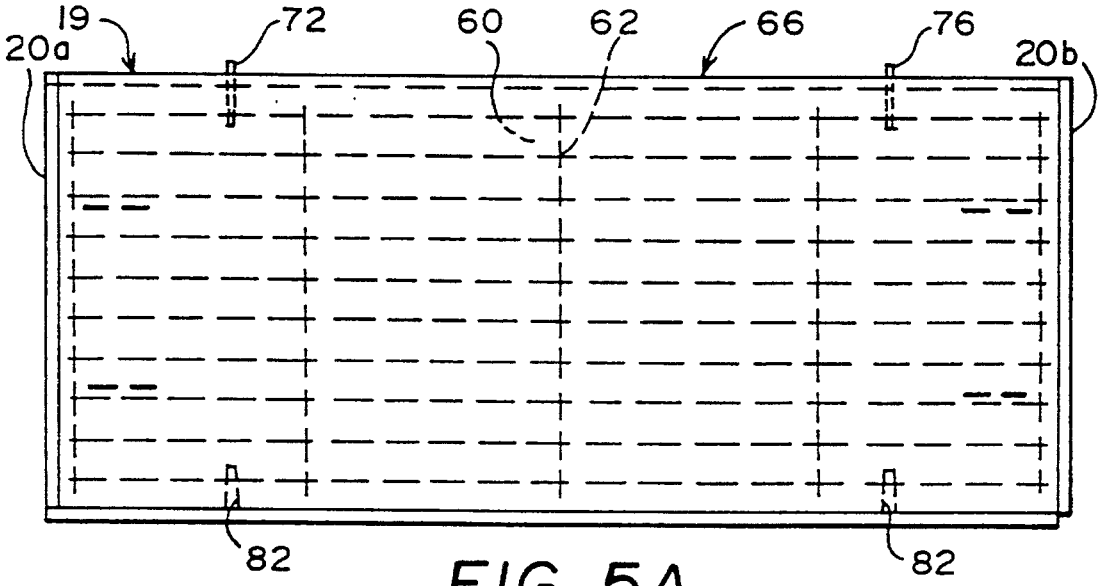
FIG. 5A
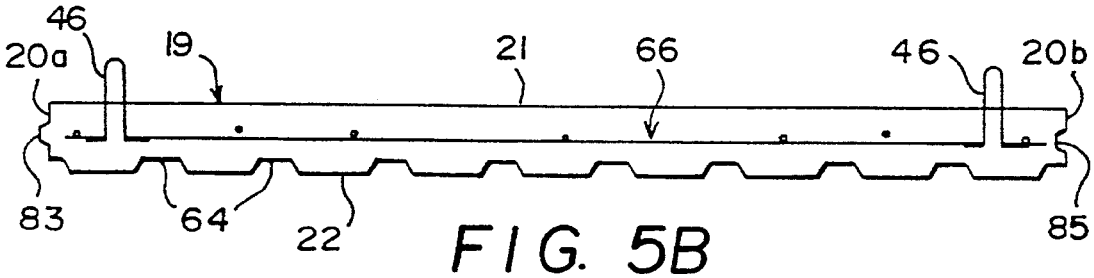
FIG. 5B
FIG. 5C
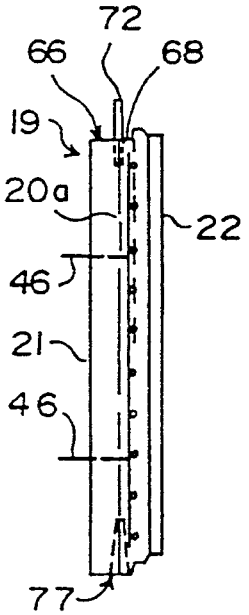
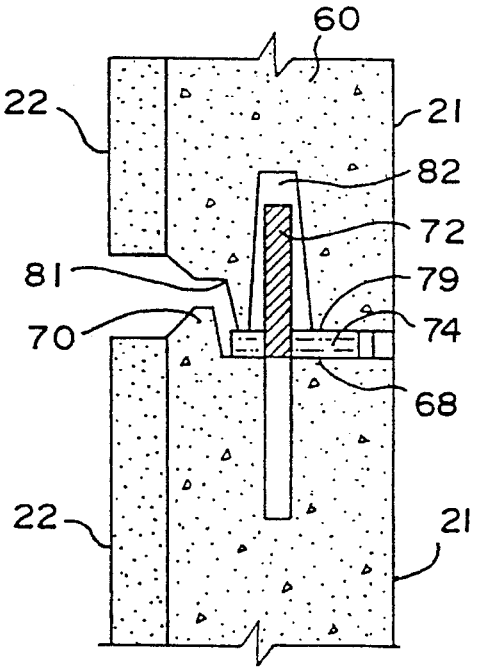
FIG. 6
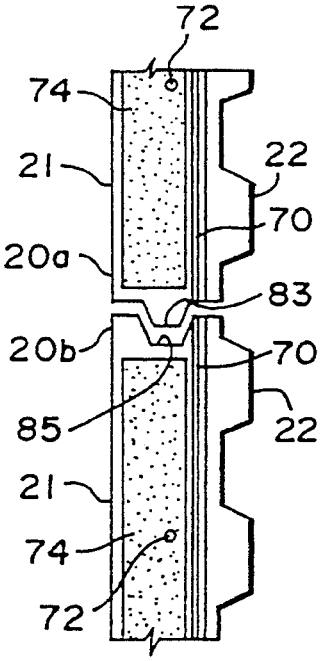
FIG. 7

SYSTEM AND METHOD FOR ADJUSTABLY ANCHORING TRAFFIC BARRIERS AND WALL FACING PANELS TO THE SOLDIER BEAMS OF A WALL

BACKGROUND OF THE INVENTION

This application is a continuation-in-part of U.S. application Ser. No. 07/958,260 filed Oct. 9, 1992 now U.S. Pat. No. 5,356,242.

This invention generally relates to pile walls, and is specifically concerned with a system and method for adjustably interconnecting wall facing panels and traffic barriers to the soldier beams of such a wall to compensate for variations in the distances between the panels and the beams, and to obviate the need for constructing a separate anchor slab for the traffic barriers.

Pile walls are commonly used as both temporary and permanent earth retaining structures. Typically, such walls are built by first installing a row of uniformly-spaced soldier beams prior to cutting the earth to be retained. The soldier beams may take the form of H-piles, I-beams, channels or the like. The soldier beams are either anchored in concrete caissons, or they are driven into the ground with suitable heavy equipment. For reasons which will become evident shortly, it is important that in either case, the soldier beams be uniformly spaced from one another, and oriented plumb with respect to the earth. After the soldier beams have been installed, the earth is excavated along one side of the beams to expose a cut face of earth, and to partially expose the front faces of the beams. The soldier beams may then be securely anchored to the mass of earth behind them by means of a plurality of tie-backs which are installed in the earthen mass and connected to the soldier beams. Lagging in the form of sprayed shotcrete or timber is then installed to temporarily retain the cut face of earth vertically in place. A leveling pad may next be constructed in front of the front faces of the beams, and pre-cast wall facing panels may then be stacked in rows to form the finished face of the wall. To complete the wall, the back faces of the wall facing panels are structurally connected to the front faces of the soldier beams, and the gap between this structural connection may be filled in either with concrete or with a water-draining, granular material such as gravel.

While such pile walls have proven to be an economical and effective means for retaining a bank of earth, problems are created when the row of soldier beams are either not properly aligned with respect to one another or are not plumb with respect to the ground. Such misalignments cause the distances to vary between the front faces of the soldier beams and the back faces of the wall facing panels. This problem is particularly acute when driven piles are used as the soldier beams, since large rocks or other obstructions in the ground can deflect a pile away from a plumb orientation as it is being driven into the earth. If the connecting system used to structurally connect the back of the wall facing panels with the fronts of the soldier beams does not compensate for the variations in the distances between these two components, the misalignment of the beams can become transmitted to the panels after the panels are connected to the beams, thereby seriously compromising not only the esthetics of the resulting wall, but its ability to perform its intended earth-retaining function as well. While systems for adjustably interconnecting wall facing panels to the soldier beams of a pile wall are known in the art, such known systems require the use of precision-machined, threaded parts which are expensive to manufacture and difficult and time-consuming to install.

Still another disadvantage associated with such prior art walls is the expense and difficulty associated with the construction of adequate traffic barriers along the crown of such walls. The construction of such barriers is necessary whenever the top edge of the wall borders a road. Federal and state regulations require such barriers to withstand an impact force of at least 10,000 lbs. before failure. To fulfill this requirement, it is necessary to provide the barrier with a substantial anchoring structure. Presently, the anchoring structure is formed from an anchoring slab that runs parallel to and under the road that the wall borders. Such anchor slabs are typically five feet wide and 12 inches thick, and integrally formed into the traffic barriers by molding the slab into the side of the barrier after laying a network of mutually interlinking reinforcing steel between the two structures. However, while such anchor slabs are effective in reinforcing the traffic barriers to the required extent, the slab must be constructed in a specially-formed trench dug between the street and the barrier that is at least five feet wide and about 2 feet deep. Additionally, the amount of concrete and steel necessary to build the five foot wide, 12 inch thick slab in the excavation is considerable.

A final disadvantage associated with prior art walls is the expense and effort involved with providing a coping over the top edges of the wall panels after the wall has been built to its intended height. Such copings are necessary both to tie together the upper edges of the contiguous panels, as well as to impart a finished look to the wall. The present manner of installing copings involves craning pre-cast coping assemblies over the upper edges of the top-most panels, which constitutes a separate and somewhat time-consuming step.

Clearly, there is a need for an adjustable connecting system which does not require the use of precision-machined, threaded parts and which is quick and easy to install in the field. Ideally, such a system should be inexpensive in its use of materials, and should further be able to accommodate substantial variations in the distances between the soldier beams and the back faces of the panels caused from soldier beam misalignment. Such a system should facilitate the rapid construction of the pile wall, and should further result in a wall which utilizes a large amount of relatively inexpensive pre-cast components and which is structurally stronger than prior art walls. The wall should further have excellent drainage characteristics and a high degree of corrosion-resistance in all of its reinforcing members. In instances where the resulting wall borders a street, it would be desirable if such a system were capable of effectively anchoring traffic barriers along the top edge of the wall without the need for constructing labor and material intensive anchoring slabs. Finally, it would be desirable if such a system were capable of providing a coping along the top edges of the wall panel with a minimum amount of additional construction effort.

SUMMARY OF THE INVENTION

Generally speaking, the invention is both a system and a method for adjustably connecting pre-cast wall facing panels and traffic barriers to the soldier beams of a pile wall that obviates or at least ameliorates the aforementioned shortcomings associated with the prior art. The system of the invention comprises at least one pre-cast wall facing panel spaced apart from one of the soldier beams, and a connecting structure cast-in-place between the beam and the panel for structurally interconnecting both the panel and the traffic barrier to the beam. The depth of the connecting structure varies to accommodate variations in the distances between the beams and panels caused by misalignments of the soldier beams. The connecting structure is formed from moldable, cementitious material, and includes at least one anchor member extending from the soldier beam to securely tie the hardened connecting structure to the beam.

The connecting structure includes an array of internal reinforcing members that is adjustable along its depth prior to the casting-in-place of the structure in order to accommodate variations in the distances between the beams and the panels. Additionally, the array of reinforcing members may structurally interlink both the traffic barrier and the beam to the cast-in-place connecting structure. The connecting structure may also include an integrally formed coping that provides a clean line over the upper edges of the wall panels with a minimum amount of additional construction effort.

In the preferred embodiment, both the front face of the soldier beams and the back faces of the adjacent wall panels include anchor members which form part of the array of reinforcing members disposed within the column after the column is cast. The adjustability of the array of reinforcing members is implemented by a stirrup bar having a U-shaped portion, and a pair of bent leg portions. The outside of the U-portion of the stirrup bar is connected to the anchor members projecting from the front face of the soldier beam, while the inside of this U-portion surrounds at least one vertically oriented reinforcing bar. The leg portions of the stirrup bar are linked with the anchor members projecting from the back faces of the wall panels, which in the preferred embodiment are U-shaped lugs formed from reinforcing steel. It is the freedom of movement or slack that the bent legs of the stirrup bar have within the U-shaped lugs projecting from the back faces of the wall panels that affords the depth-adjustability of the resulting array of reinforcing members within the cast-in-place column. The array of reinforcing members further may include hoop-shaped members that project out of the cast-in-place connecting structure and form part of the reinforcement structure of traffic barriers that are later cast-in-place over the connecting structure, thus structurally interlinking them.

The cast-in-place connecting structure of the system advantageously accommodates variations in the distances between the soldier beams and the back faces of the panels caused from misalignments of the soldier beams. The system is particularly applicable to pile walls requiring traffic barriers that utilize piles such as H-piles or I-beams as soldier beams. It should be noted that the casting of the, cementitious material forming the connecting structure around its internal array of reinforcing members (which are typically made of a corrodible metal, such as steel) insulates these corrodible members from ambient air, soil, and water, thereby protracting their lifetimes.

In the preferred method of the invention, a pile wall is first constructed from a plurality of interfitting wall panels and soldier beams. This is accomplished by first securing the soldier beams into the ground, and then making an excavation to expose their front faces, whereupon lagging is installed. A footing foundation is then laid. A first row of wall facing panels is laid along the footing foundation in an interfitting, side-to-side relationship with their bottom edges abutting the footing. Next, an array of reinforcing members is positioned between the side edge portions of the panels and the front face of the opposing soldier beam. Side forms are then positioned on either side of the reinforcing array, and a cementitious material is cast in the mold defined between the side forms, and the front face of the soldier beam and the back faces of the two adjacent side edge portions of the panels to form a section of a connecting column. The bottom edges of a second row of wall facing panels are stacked over the top edges of the first row, and the process is then repeated. Water draining, granular filler material is poured in the spaces between adjacent column sections as the connecting columns are erected. When the wall achieves the desired height, the previously described connecting structure is formed by first laying an array of depth-adjustable reinforcing members on the: top of the connecting column between anchor members projecting from the front face of the panels, and the anchor members projecting from the soldier beams, and then by casting cementitious material over the array. Preferably, some of the reinforcing members include hoop-shaped members in the space between the soldier beams and the panels that extend from the top surface of the connecting structure after it is cast to structurally connect a cast-in-place traffic barrier to the structure. The connecting structure is further preferably molded to include an integrally formed coping.

The connecting structure obviates the need for the construction of a separate anchor slab to secure the traffic barrier by structurally securing it to the soldier beams, and also obviates the need for the construction of a separate coping.

BRIEF DESCRIPTION OF THE DRAWINGS

FIG. 1 is a front view of a pile wall built in conformance with the connecting system and method of the invention;

FIG. 2 is a side view of the wall of FIG. 1 along the line 2—2, illustrating a cross-sectional side view of the cast-in-place connecting column of the system of the invention;

FIG. 3 is an enlargement of the area enclosed in FIG. 2 by the dotted circle;

FIGS. 5A, 5Bb, and 5C are a front, plan and side view of one of the precast panels used in the facing wall of the wall;

FIG. 6 is an enlarged, cross-sectional side view of two stacked precast panels of the type illustrated in FIG. 5A, 5B, and 5C, demonstrating how the alignment pins and conical openings on the upper edge of the bottom panel and the lower edge of the top panel fit together to align and secure the two panels;

FIG. 7 is a plan view of two panels in a side-to-side relationship, wherein a tongue on one side edge portion of one panel is received within a groove on the side edge portion of another panel;

DETAILED DESCRIPTION OF THE PREFERRED EMBODIMENT

Figure 8A:
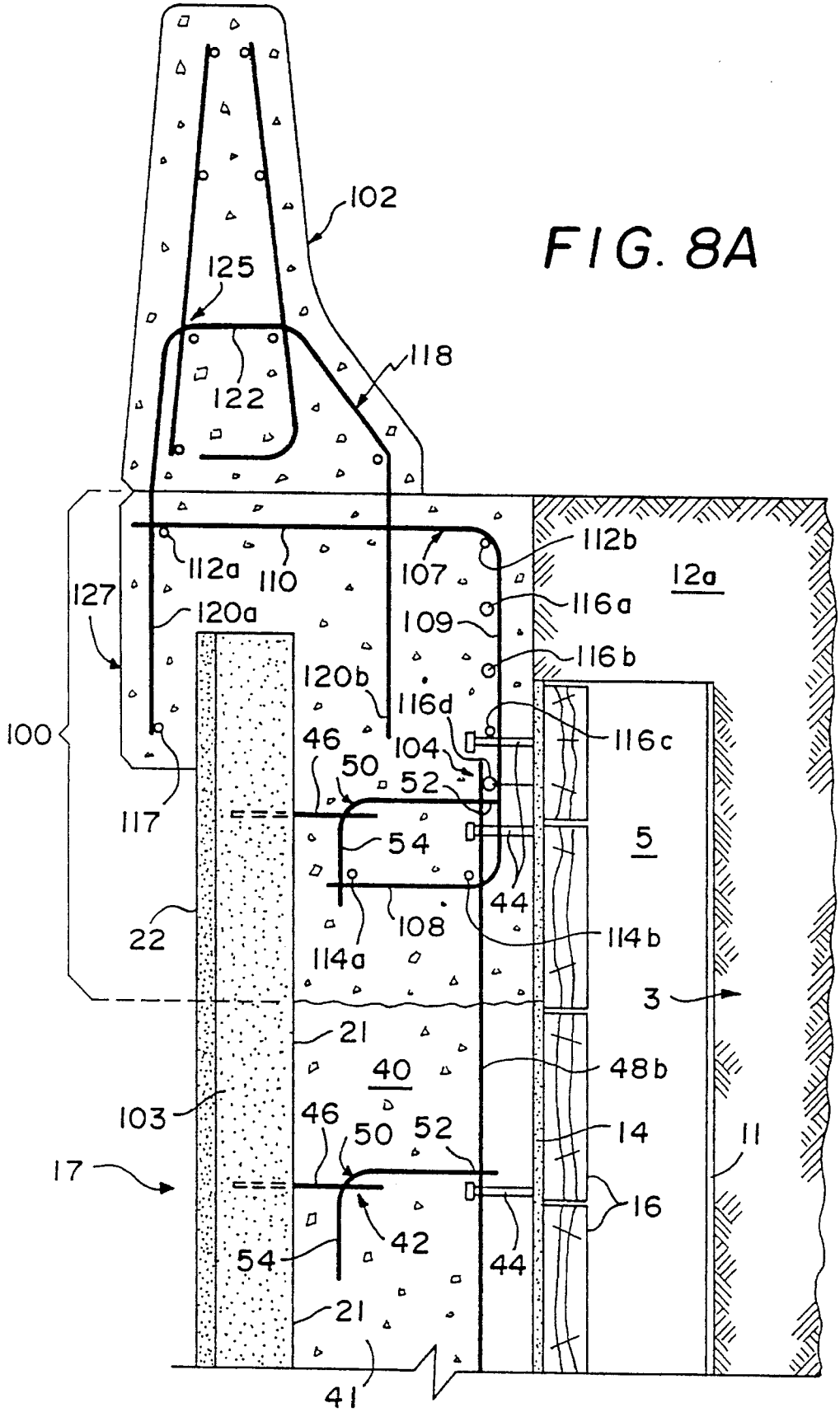
FIGS. 8A and 8B are side and plan cross-sectional views of a wall of the invention having a traffic barrier secured to the soldier beams of the wall by a connecting structure.

With reference now to FIGS. 1, 2, and 8A, the connecting system and method of the invention is particularly adapted for use in a wall 1 of the type that retains the cut face 3 of an excavation in the earth. Such walls 1 are formed from a row of soldier beams 5 which may be I-beam type piles which are first driven into the earth such that their bottom ends 7 are sunk well below the floor level of the excavation to be made, while their top ends 9 define the height of the wall 1 to be built. An excavation is then made to form the cut face 3, which partially exposes the soldier beams 5. In the case of a tie-back wall, the beams 5 are secured to tie-backs 13 (only partially shown) which are anchored deep in the ground opposite the front face of the wall 1. Lagging 15 is then constructed between the front face or flange 14 and the back face or flange 11 of the beams 5 in order to retain the earth forming the cut face 3 while the construction of the tie-back wall 1 is completed. As is best seen in FIGS. 4 and 8A, lagging 15 is formed from timber 16 which is slid behind the from flanges 14 of adjacent beams 5.

The wall 1 further includes a facing wall 17 spaced apart from the row of beams 5 which is formed from a plurality of pre-cast facing panels 19 stacked as shown in FIG. 1. Each of the pre-cast facing panels 19 includes a pair of opposing side edge portions 20*a*, 20*b*, as well as a back face 21 and a front face 22. Facing wall 17 has a bottom edge 23 which overlies a footing foundation 24. The function of the footing foundation 24 is not merely to cream a level support surface for the bottom edge 23 of the facing wall 17, but to completely support the entire weight of not only the facing wall 17, bat the upper traffic barrier 34, the cast-in-place connecting columns 40 and the water-conducting, granular filler 37 disposed between the facing: wall 17 and the lag wall 15. To this end, the footing foundation 24 is constructed from a row of rectangular foundation pedestals 25 which are formed from steel reinforced concrete. In the event that the bottom of the wall 1 borders an automobile right-of-way, a row of lower traffic barriers 26 may be placed on the lower outside face of the facing wall 17 in order to protect the lower-most, pre-cast facing panels 19 from being directly struck by an automobile. If such traffic barriers 26 are included as part of the tie-back wall 1, the base portion 27 of the barriers 26 is buried below the ground level 28 so that only the upper portions 29 overlap the lowermost, exposed portion of the facing wall 17. Such construction helps to secure the traffic barriers 26 in their protective position with respect to the lowermost panels of the facing wall 17. The facing wall 17 further includes a top edge 30 over which a layer of leveling concrete 31 and a plurality of pre-cast copings 33 are shown. Upper traffic barriers or parapets 102 may in turn be placed over the top of the wall 1 bordering an automobile right-of-way. The invention encompasses the use of a connecting structure 100 formed on top of a connecting column 40 to secure the barrier 102 to the beams 5, thereby obviating the need for an anchoring slab. Such a connecting structure 100 is described in detail hereinafter.

Figure 4:
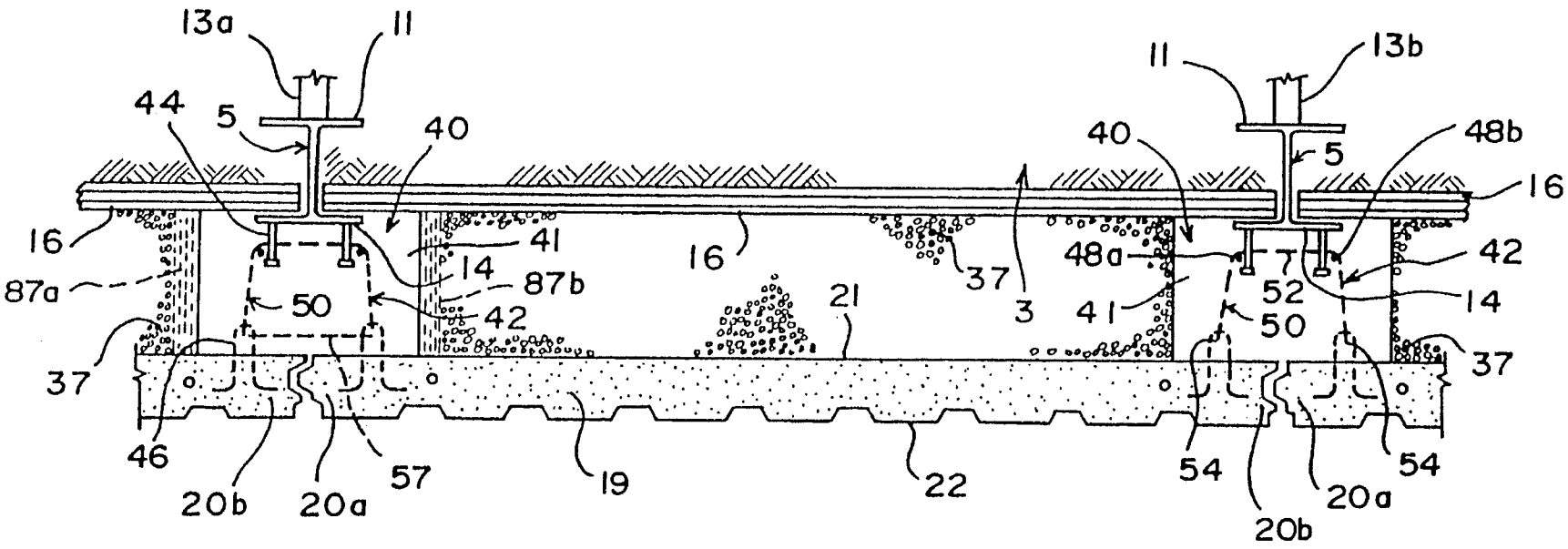
FIG. 4 is a plan view of the wall illustrated in FIG. 1 with the coping, traffic barriers, and upper surface of grading removed.

With reference now to FIG. 4, most of the space between the facing wall 17 and the lag wall 15 is filled in with a water-conducting, granular filler 37 such as gravel or crushed rock. Such granular filler 37 helps to structurally integrate the facing wall 17 with the cut face 3, while at the same time providing an ample amount of water drainage in this area. To insure that water will not collect between the facing wall 17 and the cut face 3, a drainage conduit 38 is provided in the position shown on top of the footing foundation 24.

With reference now to FIGS. 2, 3, and 4, the connecting system used in conjunction with the invention generally comprises a cast-in-place connecting column 40 for structurally interconnecting the front faces 14 of the beams 5 with the side edge portions 20*a*, 20*b* of the panels 19 that make up the facing wall 17. Each of the cast-in-place connecting columns 40 is formed from a cementitious material 41 such as concrete which is cast over an array of reinforcing members 42. As will be seen in more detail hereinafter, because the connecting columns 40 are cast-in-place, variations in the distances between the front faces 14 of the beams 5 and the back faces 21 of the precast facing panels 19 are automatically accommodated by the liquidity of the cementitious material that hardens to form the resulting column 40 to create a column 40 whose depth is exactly equal to the distance between the from face 14 of the beams 5 and the back face 21 of the panels 19.

Figure 9A:
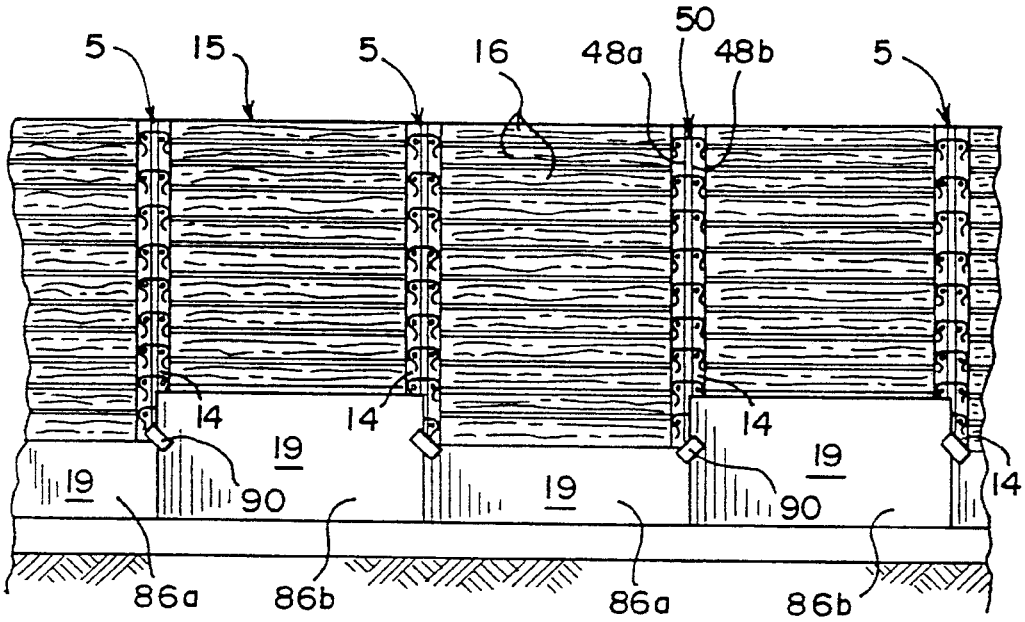
FIGS. 9A and 9B are front views of a wall being assembled in conformance with both the system and the method of the invention.

The array 42 of reinforcing members that forms the skeleton of the cast-in-place columns 40 is formed in part from a plurality of studs 44 which protrude off of the front face 14 of the beams 5. These studs are arranged in horizontally opposing pairs on the front faces 14 of the beams 5, which pairs are vertically spaced apart along the lengths of the beams 5. Further included within the array 42 are U-shaped lugs 46 which project from the back faces 21 of the panels 19. A third element of the array 42 is a pair of vertically oriented reinforcing bars 48*a*, 48*b* which are parallel with respect to one another and disposed along the outer sides of the opposing pairs of studs 44 projecting from the beams 5. Linking together the studs 44, the U-shaped panel lugs 46 and the vertical reinforcing bars 48 are a plurality of stirrup bars 50 whose structure is best seen in FIGS. 3, 4, and 9A. Each of the stirrup bars 50 includes a U-shaped portion 52 at one end which hangs over a pair of opposing studs 44 which project from the front face of the beams 5 as shown. Each of these stirrup bars 50 further includes a pair of opposing legs 54 at its other end which are received within one of the U-shaped panel lugs 46 from different side-to-side panels 19, as can best be seen in FIGS. 3 and 4. Because the opposing legs 54 of the stirrups 50 can be inserted anywhere within U-shaped panel lugs 46 and still effectively link these lugs 46 with the studs 44 and vertical reinforcing bars 48A, 48B, the resulting array 42 of reinforcing member is adjustable in the depth-wise direction from the distance D as shown in FIG. 3. Such depth-wise adjustability of the array 42 allows the array 42 to effectively reinforce the surrounding cementitious material 41 that forms the connecting column 40 over a relatively large depth-wise distance, thus helping to create a connecting column structure which can accommodate broad variations in the distance between the front face 14 of the beams 5 and the back face 21 of the precast facing panels 19 without any compromises in structural strength. Of course, for heavier structures, a pair stirrup bars 50 could be used having mutually opposing U-shaped sections 52 and mutually overlapping legs 54. Alternatively, a cross member 57 may be tied between the legs 54 after the legs have been dropped into the lugs 46 of the opposing panels 19, as shown in FIG. 4. Finally, square stirrups of different sizes could be used to accommodate different column depths. In the preferred embodiment, the studs, the lugs 46, the vertical reinforcing bars 48*a*, 48*b*, and the stirrup bars 50 are all formed from epoxy-coated structural steel in order to discourage corrosion in the form of rust on these reinforcing members. The cementitious material 41 which surrounds each of the members of the array 42 of reinforcing members assists in preventing undesirable corrosion from occurring by insulating each of these reinforcing members from ambient air, soil, and water.

With reference now to FIGS. 5A, 5B, and 5C, the precast facing panels 19 that form the facing wall 17 are, like the columns 40, formed from a cementitious material 60 cast around a grid 62 of reinforcing members formed from structural steel. The front face 22 of each of the panels 19 may include an architectural finish such as the decorative flutes 64 shown, while the back face 21 may be screeded. To aid in the construction of the tie-back wall 1, each of the edges of the facing panels 19 includes a means for interlocking with the edge of an adjacent panel 19. For example, with reference now to FIGS. 5B, 5C, and 6, the top edge 66 of each of the panels 19 includes a recessed top wall 68 bordered by a linear lip 70. A pair of alignment pins 72 (which are preferably formed from plastic dowels) extend from the recessed top wall 68 of the top edge 66 of each of the panels 19. As is seen in FIGS. 6 and 7, a bearing pad 74 formed from a strip of plastic overlies the recessed top wall 68 for a purpose which will become evident shortly. With reference again to FIGS. 5B, 5C and 6, the bottom edge 77 of each of the facing panels 19 includes a protruding bottom wall 79 bordered by a linear recess 81 which is generally complementary in shape to the lip 70 disposed on the top edge 66 of each of the panels 19. Additionally, the bottom edge 77 of each of the panels 19 includes a pair of conical openings 82 which are spaced apart the same distance as the alignment pins 72 for receiving these pins when one panel is stacked on top of another panel, as is shown in FIG. 6. The placement of the conical openings 82 on the bottom edges of the panels 19 prevents them from collecting water. The receipt of the alignment pins 72 within the conical openings 82 not only properly aligns the panels 19 as they are stacked so that their opposing side edge portions 20*a*, 20*b* are in alignment, but further helps to secure the panels 19 in such a stacked relationship which in turn facilitates the erection of the facing wall 17 during the construction of the wall 1. The provision of the resilient bearing pad 74 creates an air and light fight seal between adjacent edges of stacked panels 19, and further helps to prevent any cracking from occurring when the panels 19 are stacked on top of one another by absorbing some of the shock when an upper panel is lowered on top of a lower panel. As shown in FIGS. 4 and 7, one of the side edge portions 20*a* of each panel 19 includes a tongue 83, while the other side edge portion 20*b* includes a complementarily-shaped groove 85. The provision of a tongue 83 and groove 85 on opposing sides of each of the panels 19 provides still another stabilizing interlock between adjacent panels 19 which helps to hold the facing wall 17 together when the columns 40 are poured.

Figure 8B:
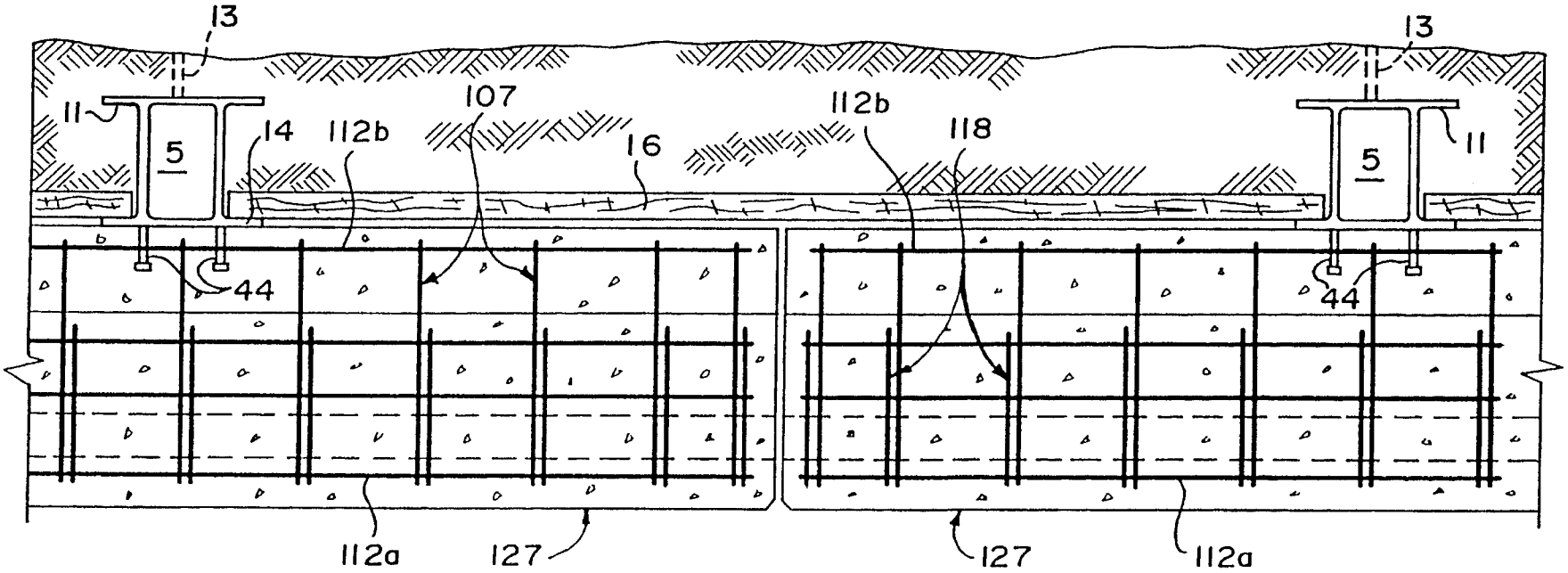

With reference now to FIGS. 8A and 8B, a cast-in-place connecting structure 100 is provided in the system of the invention for anchoring both an upper traffic barrier or parapet 102 and an upper wall panel 103 to the upper ends of the soldier beams 5. To this end, the connecting structure 100 is integrally molded between the upper end of the previously described connecting column 40 and the upper traffic barrier 102. Like the connecting column 40, the connecting structure 100 has an internal array 104 of reinforcing members that includes the studs 44 projecting outwardly from the front flange 14 of the soldier beams 5. The inclusion of the studs 44 of the soldier beams 5 in the internal array 104 of reinforcing members secures the structure 100 to the beams 5, which is necessary for the structure 100 to perform its function in transferring impact forces from the upper traffic barrier 102 to the beams 5.

At its lower portion, the internal array 104 of reinforcing members of the structure 100 includes the same reinforcing members as the connecting column 40, i.e., the previously described vertical bars 48*a,b*, the stirrup bars 50, and the lugs 46 projecting from the back surface 21 of the upper panel 103. The inclusion of these reinforcing members provides the lower portion of the connecting structure 100 with the same depth-wise adjustability associated with the connecting column 40. At its upper portion, the internal array 104 includes a plurality of spaced apart angular reinforcing members 107 having a bottom leg 108, a vertically-oriented leg 109, and an upper leg 110. Prior to the casting-in-place of the connecting structure 100, the angular reinforcing members 107 are supported in the position shown by a pair of parallel, horizontally oriented, upper reinforcing bars 112*a,b*, disposed under their upper legs 110. The bottom leg 108 of the angular reinforcing members 107 in turn supports a pair of horizontally oriented, parallel lower reinforcing bars 114*a,b*. Side reinforcing bars 116*a—c* are disposed along the vertical leg 109 of the angular reinforcing member 107. As may best be appreciated with respect to FIG. 8B, the angular reinforcing bars 107 are preferably uniformly spaced apart a maximum distance of one foot to insure adequate strength.

Further included in the internal array of reinforcing members 104 of the cast-in-place connecting structure 100 are a plurality of hoop-shaped reinforcing members 118. Each of the hoop-shaped reinforcing members 118 includes a pair of spaced apart legs 120*a, b* as shown. The fight leg 120*b* lends structural reinforcement to the upper portion of the structure 100, while the left leg 120*a* reinforces the coping portion 127 of the connecting structure 100. A horizontally oriented reinforcing bar 117 is tied to the bottom end of the left leg 120*a*. Each of the hoop-shaped reinforcing members 118 further includes a trapezoidally-shaped upper portion 122 that extends above the connecting structure 100 after the structure has been cast. As may best be seen with respect to FIG. 8A, the upper portion 122 of the hoop-shaped reinforcing members 118 advantageously forms part of the reinforcing array 125 of the upper traffic barrier 102, thereby structurally connecting the traffic barrier 102 to the connecting structure 100 when the barrier 102 is cast-in-place. Pavement or grading 129 is provided between the top edges of the soldier beams 5 and the upper surface of the connecting structure 100 in order to bring the level of the overall wall structure up to the level of the road that runs along its crown.

Figure 9B:
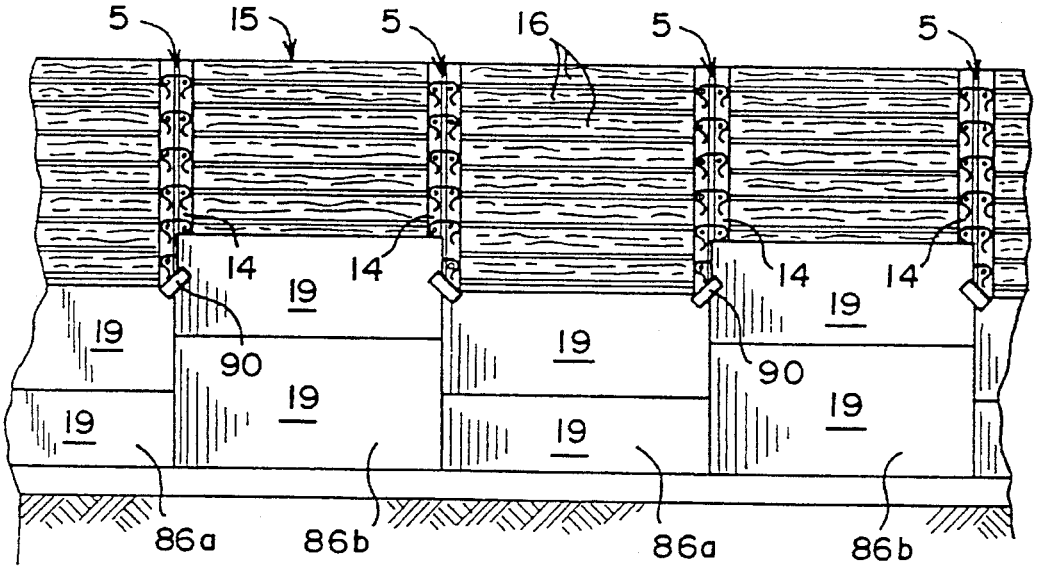

FIGS. 9A and 9B illustrate the connecting method of the invention which takes place after the beams 5 have been driven in the earth, the cut face 3 excavated, and the lagging 15 built. In the first step of this method, the previously described footing foundation 24 is cast and installed in the position illustrated in FIG. 2. Next, the studs 44 of the reinforcing array 42 are welded on the front face 14 of the beams 5 in opposing pairs as is shown in FIG. 9A and 9B. After all of the studs 44 have been installed, the vertical reinforcing bars 48*a*, 48*b* are secured onto their respective column of studs by wire twists of the type commonly used to mount reinforcing steel prior to a casting operation. The U-shaped portion 52 of a stirrup bar 50 is then hung over every one of the opposing pairs of studs 44 as shown, with the two parallel reinforcing bars 48*a*, 48*b* contained within the U-shaped portion 52 such that the stirrup bar 50 will not easily fall off from the pair of opposing studs 44 from which they hang. The next step of the method may best be seen with reference to FIG. 4 and 9A. In this step, a bottom row of precast facing panels 19 is laid on top of the footing foundation 24 in spaced apart relationship with respect to the front faces 14 of the beams 5. This first bottom row of panels 19 is formed alternately from half-size panels 86*a* and full-size panels 86*b* in an imbricated pattern to better support the second row of panels that will be stacked over it. These panels are laid out in a straight row, with their opposing side edge portions 20*a*, 20*b* closely adjacent to one another such that the tongues 83 on one side of each of the panels 19 is closely received within the groove 85 present in the side of the adjacent panel 19. The tongue and groove relationship between adjacent panels 19 causes each of the panels 19 to be strongly supported against falling over by the two panels on either side of it.

The opposing legs 54 of the stirrup bars 50 are next dropped into the lugs 46 of the two adjacent panels 19 opposing the front face 14 of the beam 5. Side forms 87*a*, 87*b* (indicated in phantom in FIG. 4) are then installed between the side edge portions 20*a*, 20*b* of the two adjacent panels 19. The side edges of adjacent panels 19 are further interconnected by means of detachably securable clamps 90, such that a concrete mold is defined between the two side forms 87*a*, 87*b* the front face 14 of the beams 5, and the back faces of the opposing side edge portions 20*a*, 20*b* of the adjacent panels 19. At this juncture, a first section of the cast-in-place column 40 is formed by pouring a hardenable, cementitious material 41 such as concrete into the previously described mold. This first section of the cast-in-place connecting column 40 is then allowed to harden. After the material 41 hardens, the side forms 87*a*, 87*b* are left to stay in place and the previously described water-conducting, granular filler 37 is poured in between the newly made column sections.

FIG. 9B generally illustrates the subsequent step of the method of the invention. In these steps, the beating pads 74 are laid over the top edges of the panels 19. Next a second row of panels 19 is stacked on top of the bottom row in the positions illustrated. In addition to the previously described, interfitting tongues and grooves on the side edge portions 20*a*, 20*b* of adjacent panels, the bottom edges 77 of each of these panels is further secured to the top edges 66 of the bottom most panels by way of the previously described alignment pins 72, and interfitting lips 70 in linear recesses 81. Additionally, the vertically staggered pattern of the panels 19 forming the first row causes the side edge portions 20*a*, 20*b* of every other panel 19 to interlock with the adjacent side edge portions 20*a*, 20*b* of two panels 19, thereby further contributing to the self-supporting strength of the facing wall 17. The opposing legs 54 of the stirrup bars 50 are again dropped into the lugs 46 of the panels forming the second row of the facing wall 17, and the side forms 87*a*, 87*b* and clamps 90 are reinstalled in the same manner as previously described. Another section of the column 40 is then poured and allowed to harden. The method is repeated until the desired height of the resulting tie-back wall 1 is obtained, whereupon the previously described connecting structure 100 and upper traffic barrier 102 are sequentially cast over the top edge of the upper wall panel 103, after their respective arrays of reinforcing members have been laid. Finally, grading or pavement 129 is added to complete construction of the pile wall 1.

We claim:

1. A system for anchoring a traffic barrier along the top edge of a wall structure of the type including at least one wall panel spaced apart from and connected to a soldier beam, comprising:

a connecting structure means cast-in-place between said soldier beam and a top portion of said wall panel for structurally interconnecting a traffic barrier to said soldier beam, said connecting structure including an array of internal reinforcing members for both strengthening said connecting structure means and for interlinking said traffic barrier thereto, the reinforcing members being adjustable in depth prior to the casting in place of said connecting structure means to accommodate variations in the distance between said soldier beam and said panel, said array of internal reinforcing members including at least one vertically oriented bar member, and a second anchor member connected to and extending from said wall panel.

2. The system of claim 1, wherein said connecting structure means further comprises at least one anchor member extending from said soldier beam for structurally linking said beam to cast-in-place material forming said connecting structure means.

3. The system of claim 1, wherein said connecting structure means includes a coping for overlying a top edge of said wall panel.

4. The system of claim 1, wherein said connecting structure means is integrally cast as part of a connecting column means that is also cast-in-place between said beam and said panel, wherein the depth of said column means accommodates variations in the distances between said panel and said beam.

5. The system of claim 1, wherein said array of internal reinforcing members further includes a stirrup having a U-shaped portion for receiving said vertically oriented bar member and at least one leg portion for interlinking with said second anchor member.

6. The system of claim 1, wherein said cast-in-place connecting structure means is formed from a cementitious material and said reinforcing members are formed from a corrodible metal, wherein the cementitious material cast around said reinforcing members insulates them from air, soil, and moisture.

7. A system for anchoring a traffic barrier along the top edge of a pile wall structure of the type including at least one wall panel spaced apart from and connected to a soldier beam, comprising:

a connecting structure means cast-in-place from cementitious material between said soldier beam and a top portion of said wall panel for structurally interconnecting a traffic barrier to said soldier beam, wherein said connecting structure means includes an internal array of reinforcing members which is adjustable in depth prior to the casting in place of said connecting structure means to accommodate variations in the distance between said soldier beam and said wall panel, said array of internal reinforcing members structurally interlinking said connecting structure means to said soldier beam and including at least one vertically oriented bar member, at least one anchor member extending from said soldier beam into the cementitious material forming said connecting structure means, and a second anchor member connected to and extending from said wall panel.

8. The system of claim 7, wherein said traffic barrier is cast-in-place over said structure means, and said array of internal reinforcing members further includes a stirrup having a U-shaped portion for receiving said vertically oriented bar member and at least one leg portion for interlinking with said second member, and a hoop-shaped member having an upper portion that extends out of the structure means after the structure means is cast-in-place to form part of a reinforcing structure for said traffic barrier.

9. The system of claim 8, wherein said array of internal reinforcing members further includes a plurality of vertically oriented angular members and horizontally oriented reinforcing bars for both reinforcing said structure means and for structurally interconnecting a plurality of connecting columns disposed between a plurality of contiguous wall panels and soldier beams.

10. A method for assembling a pile wall out of structural steel beams and pre-cast wall facing panels having opposing side edge portions, comprising the steps of:

driving a row of soldier beams into the ground in uniformly spaced apart relationship;

excavating a cut face in the earth so as to partially expose said beams;

laying a footing foundation in front of said beams;

laying at least two panels on said footing foundation in a side to side relationship wherein the mutually adjacent side edge portions are spaced directly apart from the exposed portion of one of said beams;

linking a first array of reinforcing members between each of said adjacent panel side portions and the exposed portion of said beams;

casting in place a length of a connecting column means between said exposed portion of said beams and said adjacent panel side edge portion to structurally interconnect them;

forming a second array of reinforcing members between top portions of said beams and a top portion of said panels to extend above the top portions of said beams and the top portions of said panels;

linking said second array of reinforcing members between top portions of said beams and the top portions of said panels;

casting in place a connecting structure means over said second array of reinforcing members, and connecting a traffic barrier to said structure means.

11. The method of claim 10, wherein said traffic barrier is cast in place over said structure means.

12. The method of claim 11 which includes casting said connecting structure means in place to leave exposed a portion of said second array of reinforcing members;

connecting a third array of reinforcing members to the exposed portion of said second array; and casting said traffic barrier in place over the third array of reinforcing members and the exposed portion of said second array.

13. A system for anchoring a traffic barrier along the top edge of a wall structure of the type including a panel wall having a top edge, said panel wall being spaced apart from and connected to spaced, vertical soldier beams comprising: an array of column reinforcing members extending between said panel wall and said soldier beams and connecting said panel wall to said soldier beams, an array of connector reinforcing members connected to said column reinforcing members and extending therefrom above the top edge of said panel wall, an array of barrier reinforcing members connected to said connector reinforcing members and extending upwardly therefrom away from the top edge of said panel wall, connecting columns of cementitious material cast-in-place over said column reinforcing members to connect said panel wall to said soldier beams, connector base means of cementitious material cast-in-place over said array of connector reinforcing members to extend from the top of said connecting columns above the top edge of said panel wall, and a traffic barrier of cementitious material cast-in-place over said barrier reinforcing members to extend above said connector base means.

14. The system of claim 13, wherein said connector base means includes a coping for overlying a top edge of said panel wall.

15. The system of claim 14, wherein said coping is integrally formed with said connecting base means, and said connector array of reinforcing members structurally reinforces said coping.

16. The system of claim 13 wherein said array of column reinforcing members is adjustable in depth prior to the casting in place of said connecting columns to accommodate variations in the distance between said soldier beams and said panel wall.

17. The system of claim 16 wherein said array of connector reinforcing members includes linking reinforcement members which extend upwardly out of said connector base means after the connector base means is cast in place, said linking reinforcement members being connected to said array of barrier reinforcing members.

18. The system of claim 16 wherein said array of connector reinforcing members is adjustable in depth prior to the casting in place of said connecting columns and connector base means to accommodate variations in the distance between said soldier beams and the panel wall.

* * * * *